US011047335B2

(12) United States Patent
Kleinwachter

(10) Patent No.: US 11,047,335 B2
(45) Date of Patent: Jun. 29, 2021

(54) MEMBRANE STIRLING ENGINE

(71) Applicant: Jurgen Kleinwachter, Kandern (DE)

(72) Inventor: Jurgen Kleinwachter, Kandern (DE)

( * ) Notice: Subject to any disclaimer, the term of this patent is extended or adjusted under 35 U.S.C. 154(b) by 175 days.

(21) Appl. No.: 15/557,841

(22) PCT Filed: Mar. 14, 2016

(86) PCT No.: PCT/DE2016/000108
§ 371 (c)(1),
(2) Date: Sep. 13, 2017

(87) PCT Pub. No.: WO2016/146096
PCT Pub. Date: Sep. 22, 2016

(65) Prior Publication Data

US 2018/0119638 A1 May 3, 2018

(30) Foreign Application Priority Data

Mar. 13, 2015 (DE) ..... 10 2015 003 147.3

(51) Int. Cl.
*F02G 1/044* (2006.01)
*F02G 1/043* (2006.01)
*F02G 1/055* (2006.01)
*F02G 1/057* (2006.01)

(52) U.S. Cl.
CPC ..... *F02G 1/044* (2013.01); *F02G 1/043* (2013.01); *F02G 1/055* (2013.01); *F02G 1/057* (2013.01); *F02G 2244/10* (2013.01)

(58) Field of Classification Search
CPC ..... F02G 1/044; F02G 1/055; F02G 1/057; F02G 2244/10
See application file for complete search history.

(56) References Cited

U.S. PATENT DOCUMENTS 1,007,422 A * 10/1911 Philips ..... B66B 7/1269 184/21
4,285,197 A * 8/1981 Cloup ..... F01B 19/00 417/367
4,490,974 A * 1/1985 Colgate ..... F02G 1/04 60/517
6,332,323 B1 * 12/2001 Reid ..... F25B 29/003 62/6
6,862,883 B2 * 3/2005 Kamen ..... F02G 1/043 165/10

(Continued)

FOREIGN PATENT DOCUMENTS

JP 2008151086 A * 7/2008

OTHER PUBLICATIONS

JP-2008151086-A English Translation (Year: 2008).*
English Translation JP 2008151086 A (Year: 2006).*

*Primary Examiner* — Shafiq Mian
(74) *Attorney, Agent, or Firm* — Butler Snow LLP

(57) ABSTRACT

The invention relates to a Membrane Stirling Engine. The inventors propose a Membrane Stirling Engine, with working gas, with a hot part and with a cold part, where the working gas of the Stirling engine is found both in its hot part as well as its cold part in the membrane skins, which have two ends, whereby they are closed on one end hermetically and on the other end they are open, where they lead into the hot or cold space of a regenerator chamber with their open end tightly sealed.

31 Claims, 10 Drawing Sheets

(56) References Cited

U.S. PATENT DOCUMENTS

| | | | | |
|---|---|---|---|---|
| 7,067,933 | B2 * | 6/2006 | Bassett | F02G 1/043 290/2 |
| 9,234,480 | B2 * | 1/2016 | Gayton | F02G 1/055 |
| 2003/0192324 | A1 * | 10/2003 | Smith | F03G 7/002 62/6 |

* cited by examiner

MEMBRANE STIRLING ENGINE

CROSS-REFERENCES TO RELATED APPLICATIONS

This application is a national stage application under 35 U.S.C. § 371 of International Patent Application No. PCT/DE2016/000108, filed on Mar. 14, 2016, which claims the benefit of German Patent No. 102015003147.3, filed on Mar. 13, 2015, both of which are incorporated herein by reference in their entirety.

FIELD OF THE INVENTION

The invention relates to a Membrane Stirling Engine.

DETAILED DESCRIPTION

Figure 1:
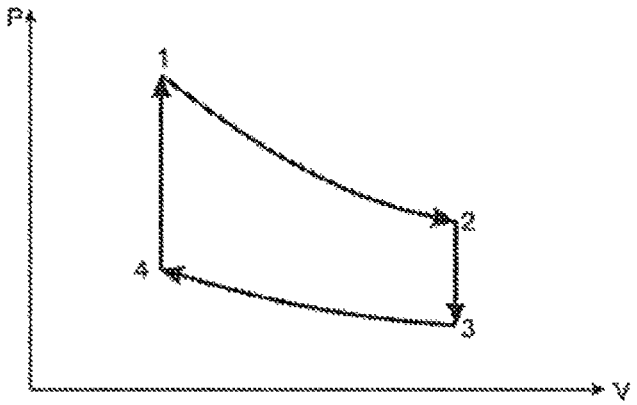
FIG. 1 depicts a PV diagram depicting the 4 process steps of an embodiment of the invention.

Classic Stirling engines consist of arrays of rigid, pressure-resistant, gas-filled cylinder, heat exchangers for heating and cooling the hermetically enclosed working gas, displacement pistons to periodically move working gas from the cold to the hot side and back, an intermediate heat generator, as well as working pistons for transmission of work generated by thermal pressure fluctuations outwards.

The Stirling engine is marked by 4 process steps in the PV diagram (FIG. 1):

1-2 isothermal expansion of the gas on the hot side under work output;

2-3 isochoric displacement of the hot working gas through the regenerator into the cold space.

3-4 isothermal compression of the cold working gas with work output;

4-1 isochoric displacement of the working gas through the regenerator in the hot space.

With good heat exchange the heaters or cooling heat-exchangers in the working gas (here, good means a low AT between heat exchanger temperature and gas temperature), good regenerator (this must have a large surface area, produce low pressure loss for the passage of gas, periodically buffer the heat content of the gas and return it again have a linear temperature coefficient in the longitudinal direction), minimum dead volume and least possible displacement work for moving the working gas back and forth, the efficiency factor of the Stirling engine comes close to that of an ideal Carnot engine with $$\eta_c = \frac{T_h - T_n}{T_h} = 1 - \frac{T_n}{T_h}$$

$$\eta = 1 - \frac{Tu}{To}$$

1. However, in the practice of the existing Stirling engines, a maximum of 50% of the theoretical Carnot efficiency is achieved due to the following restrictions:
2. Large AT between the heat exchangers and the working gas.
3. No isothermal expansion and compression
4. Unavoidable dead volumes for example through air fin coolers and geometric restrictions between rigid displacement pistons, cylinder walls, flow channels, etc.

The invention forms the basis of providing an alternative or improvement to the state-of-the-art technology.

This task is performed by a membrane Stirling engine with the characteristics of the independent patent claims.

Optional features are given in the sub-claims and the description as well as the figures.

In particular, the inventors have identified the problem from the state-of-the-art technology, that the ideal thermodynamic process assumes that the release proceeds isothermally. The released medium must also be added during the released state. A blister is foreseen in the invention. The pressure is the same inside and outside, therefore the required deformation work is zero.

According to the invention, the Stirling engine has a special, specific design: The working gas of the Stirling engine is located both in its hot part as well as its cold part, in the membrane skin with negligible flexural rigidity, which are attached to one end hermetically, and which open up with its open end tightly as a last point, into the hot or the cold space of a regeneration box.

The gas to be heated is found for example in pouches, which are formed of thin-walled membrane skins of negligent flexural rigidity. These membrane bags hermetically seal the working gas such as helium or hydrogen and open into the regenerator boxes on their face-side. The membrane bags I arranged on the right and left of the regenerator boxes together make up a gas-tight and leak tight unit with this. There is as much gas filled as the gas volume of the regenerator chamber 6 and as per half of the maximum volume of both bags.

The membrane bag 1 is located in an immersion of hot or cold fluids. The regenerator chamber 6 separates the hot liquid space from the cold liquid space.

The entire unit of gas-filled membrane bags 1, regenerator chamber 6 and heat-transmitted hot or cold fluids are found for their part, in a closed, liquid-tight and pressure-resistant housing.

The hot fluid space, as well as the cold space are provided with hydraulic pistons (or similar technical means such as bellows, hydraulic cushion and the like), which can precisely displace the volume of liquid, which corresponds half of the maximum gas volume in the membrane bags 1.

The hydraulic pistons arranged both on the hot and the cold side of the pressure-resistant housing are connected to one another in such a way that they move towards one another with a corresponding phase shift (typically: 90°). The rotary axis of the eccentric (or an equivalent technical device, such as a swash plate or a cam plate) is fitted with a flywheel 5. The described configuration corresponds to a Stirling engine of the alpha-design.

Figure 2:
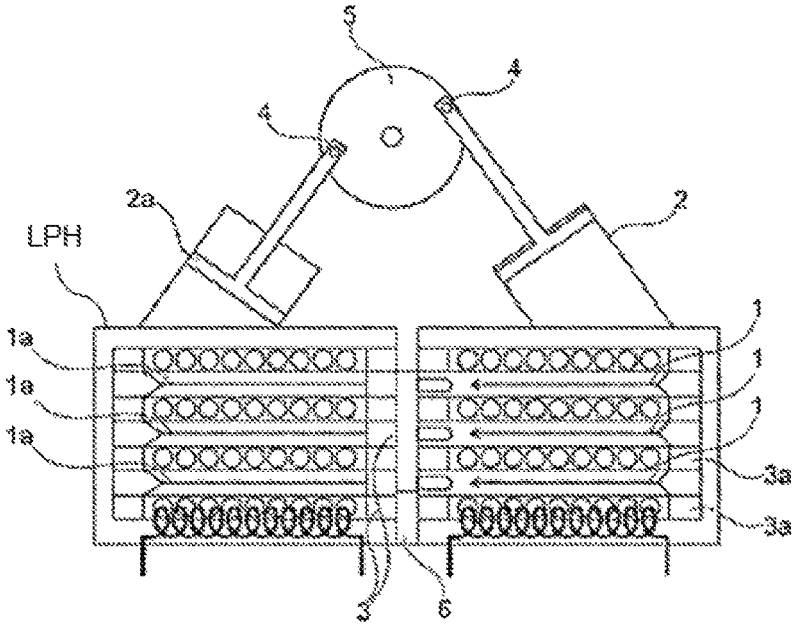
FIG. 2 depicts the structure of an embodiment of the invention in alpha construction.

FIG. 2 shows the structure of the membrane Stirling engine in alpha construction according to the invention.

1) Membrane bag, filled;

1*a*) Membrane bag, imploded at volume zero;

2) Hydraulic displacement+working piston at top dead center;

2*a*) Hydraulic displacement+working piston at bottom dead center;

3) Hot fluid;

3*a*) Cold fluid;

4) Ex-Center transmission;

5) Flywheel 5;

6) Regenerator chamber.

According to the invention, the membrane Stirling engine avoids the weaknesses of classical Stirling engines mentioned (large AT between heat exchangers and working gas; polytropic expansion and compression of the working gas instead of isothermia; dead volumes) on the basis of the following effects:

1. Very good heat transmission of hot 3 or cold fluid 3A through the thin membrane into the working gas.
2. The pulsating membrane bag 1 causes a periodic reversal of the direction of flow of the gas in the membrane bags 1. This results in a good mixing of the body of gas and a good heat entry via the membrane walls.
3. The pulsing bags collapse to zero periodically under the effect of the hydrostatic force effecting uniformly on you acting hydrostatic force of the surrounding liquid.

In this case, a geometry of bags (low thickness), which correspond to the conditions of the microwave exchangers with the typically highly increased heat exchangers of the wall in the gas, will go through.

The combined effect of these three effects leads to a significantly improved overall heat transfer, compared with classic rigid heat exchangers. This in turn leads to increased surface-specific performance of the heat transfer and thus to smaller temperature differences between the heating or cooling liquid and the working gas.

In the form of FIG. 2, cylindrical tubes are designed as membrane bags, where membrane skin-regenerator units are positioned in an interior of a pressure-resistant, liquid-tight housing LPH.

The fact that the heat flow exchanged by the thin, pulsating membrane of the gas bag with the hot or cold fluid is very effective, leads to the desired isothermalization in connection with the order of magnitude of greater heat capacity of the fluid, compared to the working gas, during the expansion or compression of the working gas (FIG. 1).

Figure 3:
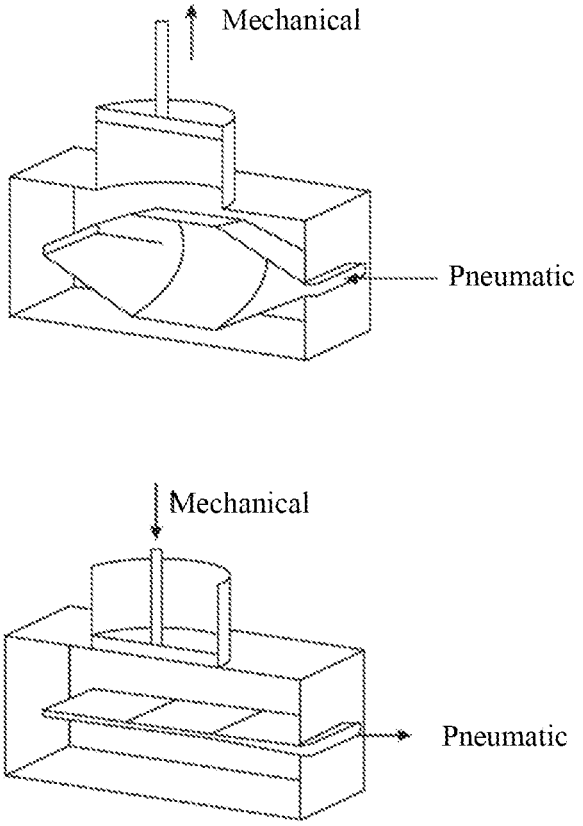
FIG. 3 depicts the principle of "pulsating" heat exchanger-displacer of an embodiment of the invention, with the help of an individual membrane bag.

In FIG. 3, the principle of "pulsating" heat exchanger-displacer is visualized, with the help of an individual membrane bag 1.

The third, serious disadvantage of classical Stirling engines, the inevitability of performance and efficiency of decreasing dead volumes, will be generally avoided, due to the topology of vibrant, gas-filled membrane bags 1 with thin walls of negligible bending stiffness, which are evenly deformed by the hydraulic pressure of the liquid surrounding them.

The membrane bag 1 is held with spring brackets at its front ends. The engine moves the content of the membrane bag skillfully, and in addition, the membrane bag 1 is a very good heat exchanger. This is because the membrane bag 1 becomes a micro-heat exchanger, whenever it is laid flat.

Figure 4:
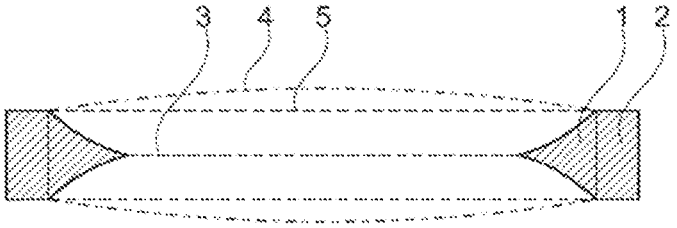
FIG. 4 depicts the schematically represented formation of a membrane bag by clamping of two planar membranes in a frame is particularly beneficia.

Typically, as shown schematically in FIG. 4, the thin membranes are stretched on the frames as planar surfaces. The frame show structures around their inner edge, which the membranes are to their inner edge around structures on which the membrane fit when pressing them softly, and without leaving behind total volumes. Similar matching profiles are formed in the areas, where the membrane bags 1 are fitted gas-tight through rigid end profiles to the regenerator chambers 6.

1) Clinging structure

2) Clamping frame

3) Membrane completely collapsed

4) Membrane in inflated state

5) Membrane stretched as an even surface stretched by frame.

Figure 5:
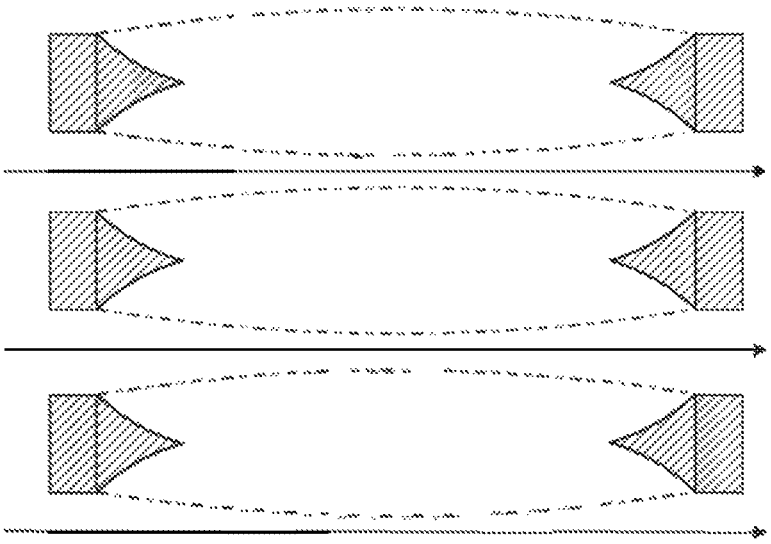
FIG. 5 depicts the his whole "stack" of membrane bags can be combined in the thickest packed form with the regenerator chamber box and thus the performance of the engine can be increased.

In FIG. 4, the schematically represented formation of a membrane bag 1 by clamping of two planar membranes in a frame is particularly beneficial, because this whole "stack" of membrane bags 1 can be combined in the thickest packed form with the regenerator chamber 6 box and thus the performance of the engine can be increased, as shown in FIG. 5

Figure 6:
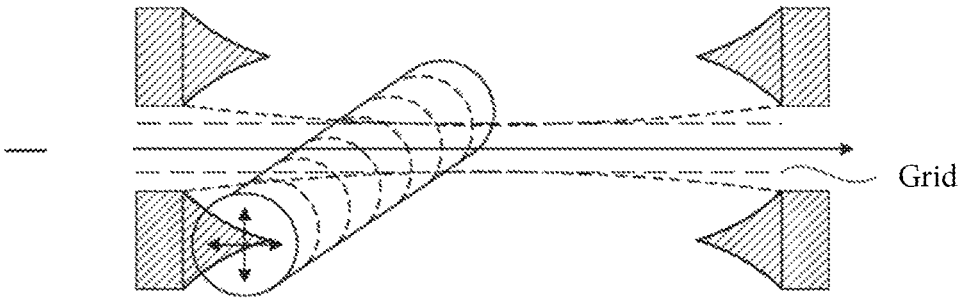
FIG. 6 depicts mechanical frame construction, which is used for receiving the "membrane bag stack" in an embodiment of the invention.

In order to avoid potential contingencies of individual membrane bags 1 in their expansion and thus interruption of the solid airflow around the membrane bag 1 with the fluid, suitable grids between two membrane bags 1 are attached as per the invention. These are incorporated in the mechanical frame construction, which is used for receiving the "membrane bag stack". FIG. 6.

The previously described, preferred variant of the membrane Stirling engine according to the invention, using plate-shaped stacks of frame-supported, gas-filled membrane bags 1, is particularly of advantage, using thin elastomer membranes. Particularly special temperature-stabilized silicones are suitable here, especially articular fluorinated silicones, which can be used for continuous temperatures up to 250° C.

As described, the innovative membrane construction a Stirling engine should achieve significantly higher Carnot implementation level, than previous engines, which reach a maximum of 50% of the Carnot efficiency.

Isothermally operating engines with low temperature storage between the working gas and the heater or cooler fluid, with minimum dead volume and the lowest possible displacement driving force (by hydrostatic deformation of thin membranes), should permit implementation levels of 80% and more. This allows good mechanical efficiency to be achieved even at relatively low heat temperatures.

This is supposed to be clear with an example: If you select water at 200° C. and 15 bar pressure as a heater fluid and water at 40° C. and 15 bar pressure as cooling fluid (the membrane bags 1 are filled with air pressure of 15 bar), an achievable thermal-mechanical efficiency of the engines results at an 80% Carnot degree of implementation:

$$\eta_{therm.mech.} = 0,8 \times 1 - \frac{313}{473} = 0,8 \times 0,34 = 0,27$$

Combined with a good electrical generator, a current conversion efficiency of approx. 0.25 can be achieved—a value, which can be achieved by classical engines, only at significantly higher temperatures.

This means that medium temperatures that can be achieved by solar energy can be converted not only without problems with simple material (water, air, steel, silicone) simply and efficiently into mechanical energy and electrical power, but also that a large number of sources of heat such as industrial waste heat or geothermal heat can be used.

A further advantage of the relatively low temperature level opens the possibility to simple pressurized water heat storage for storing cost-effective solar heat and thus to use the solar operation of such engine s round-the-clock (power and autonomy of power).

The same connections make it possible also to convert heat potentials of substantially lower temperature, for example geothermal heaters or heat from normal solar panel collectors below 100° C. with efficiency of approx. 10% into electricity, with the membrane Stirling engine, as per the invention.

Since Stirling engines can be used reversibly as a cooling engine and as heat pump, however, could use this principle technically so far only for very big temperature differentiators (Cryogenic cooling), due to the restriction of expensive and relatively low-power heat exchangers of the classical construction, the reversible (mechanically driven) Membrane Stirling engines with design according to the invention open very good new opportunities.

Thermodynamically, such engines are basically more superior to the compression cooling engines used today with regard to cold and performance figures. A further advantage with regard to the state of the art is justified by the fact that such cooling engines/heat pumps do not require air polluting refrigerants and can manage with only air, water, antifreeze and conventional structural materials (steel or fiber reinforced plastics).

The same positive argument also becomes important and also especially for solar power plants with combined heat storage for the implementation of autonomous "island solutions".

In contrast to photovoltaics, which has to rely on strategic and rare materials, which are also harmful to the environment, in particular in the storage of electrical energy (lead, cadmium, Lithium, etc.), the advantage of the membrane Stirling engines lies precisely in the fact that only abundantly available, cost-effective and environment-friendly material are required to be used and in the case of the storage of pressure-free (t<100° C.) or pressure water storage (T>100° C.).

In contrast to the photovoltaics, which in principle provides only electrical energy, the use of thermal engines has the additional advantage of automatically providing power, electricity, cooling or heat and waste heat (combined heat and power) and thus providing the whole range of decentralized required forms of energy so much better.

In combination with the aforementioned heat storages (which can also be realized as latent or thermo-chemical storages or by using biomass/gas), the local autonomy is thus possible without the necessary recourse to the complex power distribution networks of the central energy supply.

While the application of the membrane Stirling engines have been described up to the low and medium temperature to be in favor so far, by using water, air, silicone or other suitable membranes, such as polyurethane elastomers), which have their upper temperature limitation at approximately 200° C., due to technical reasons, and thus are limited to a maximum electricity generation efficiency of approx. 25%, basically higher temperatures and efficiency are possible with special materials of the membrane and operating fluids with the membrane Stirling engine.

If for example, high quality silicone thermal oil is used as a working fluid at a temperature range of approx. 400° C. and if temperature-resistant compound materials (carbon fibers with carbon membranes, or special elastomers) are used for the membranes, efficiency can be achieved at a cooling temperature of 40° C. degrees.

$$\eta_{therm.mech.} = 0,8 \times 1 - \frac{313}{673} = 43\%$$

However, solar thermal engines will only have the potential to compete with inherent, wear-free solar semiconductors (photovoltaics, thermal electrical connection), if they can be produced inexpensively and are extremely long-lasting and low-maintenance. The price target can be achieved by the choice of material. The principle of hydrostatic, gentle deformation of thin, elastic membranes with relatively low operating frequencies (some Hertz), there is basically a potential for extreme longevity, in contrast to the established technologies with classic mechanically operated displacers and the necessary seals.

The principle of the membrane Stirling engine is however not limited to the above described, preferred topology of membrane film bags. As it is apparent from FIG. 7, for example, also thin-walled hoses in various configurations can be used. According to the invention, these can be so fiber-wrapped that they are pressure-resistant in the unfolded state with a circular cross-section, and nevertheless can be hydrostatically deformed virtually free of force (due to their negligible bending stiffness).

Figure 7:
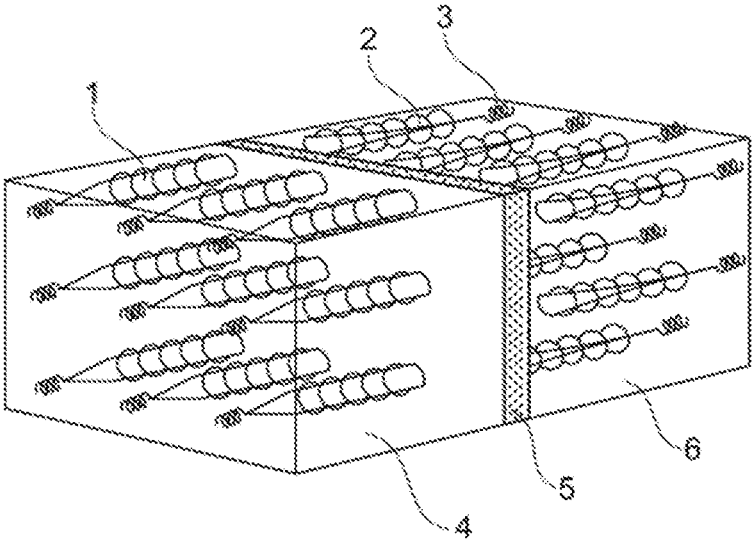
FIG. 7 depicts an embodiment of the invention using thin-walled hoses in various configurations.
Figure 8:
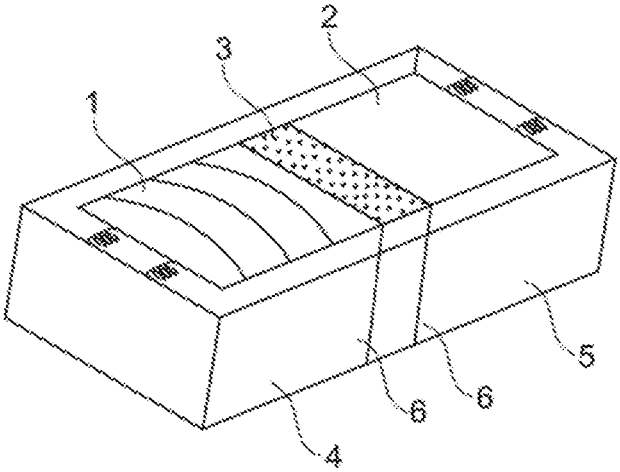
FIG. 8 depicts an embodiment of the invention wherein foil tubes are passed through corresponding slots heat insulating plates.

As it is apparent from FIG. 7, these hoses can integrated in a Stirling engine, without the need for a clamping into the frame constructions as described so far and without the necessity of a form-limiting intermediate grid.

1) Fiber-wrapped hoses, unfolded
2) Fiber-wrapped hoses, flat collapsed
3) Springs
4) Hot fluid
5) Cold fluid
6) Regenerator spacing Another particularly easy formation of the membrane Stirling engine can be achieved by the use of continuous hot film tubes in the cold spaces. The foil hoses (which are as wide as possible) are closed in their open ends by mechanical terminal strips in the form of lines. They are attached to these, by means of springs 3 on the wall of the hot or cold fluid chamber. In the central zone of the hoses, they are filled with regenerator material. The hot fluid 4 space is separated from the cold fluid 5 space through intermediate space formed by one of the two heat insulating plates. The foil tubes are passed through the corresponding slots in these plates (FIG. 9).

1) Hose, unfolded
2) Hose, collapsed
3) Regenerator material in the hose
4) Hot fluid
5) Cold fluid
6) Insulating walls through which the hoses pass through The intermediate space between the plates is filled with water, which is endowed with a gelling agent so that no thermal convection occurs in this intermediate zone.

Such a design of the membrane Stirling engine is especially suitable for pressure-free large machines built in the ground.

Figure 9:
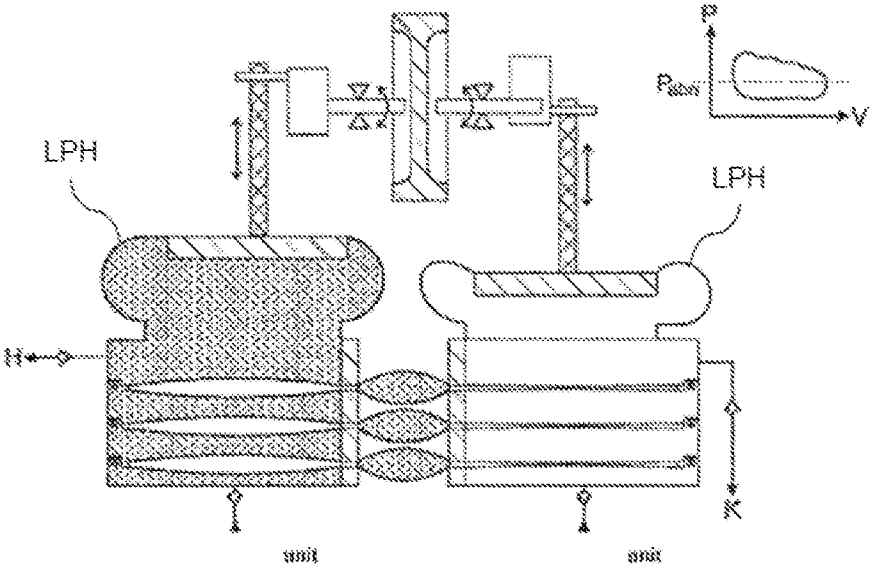
FIG. 9 depicts an embodiment of the invention presented schematically.

In FIG. 9, such a machine is represented schematically. In this, a square pit is embedded in the ground. The walls of this pit are thermally insulated—typically with a rot-proof, closed-porous insulation material such as foam glass, where membrane skin-regenerator units are positioned in an interior of a pressure-resistant, liquid-tight housing LPH.

Through the interstitial channel installed in the middle of the pit, which consists of two vertical foam glass walls, the pit is divided into two identical big chambers, one of which is filled hot water and the other with cold water. The interstitial channel is also filled with water, endowed with a gelling agent so that the water is formed into gel. In this way, the gel-like water while stabilizes the interstitial channel mechanically against the pressure fluctuations generated by the Stirling cycle in the two working chambers, but does not transport any heat any more by convection. This is important so that the linear temperature coefficient, which is built up during operation in the regenerators, is not destroyed.

Two mechanically stable, heat insulated circular working pistons are arranged on the tops of the hot and cold work chambers. These hang in a large tire, in which one lip is tightly connected at its periphery, while the other lip is tightly connected to a similar circular profile of the hot or cold chamber. In this manner, the tire performs the function of a robust "piston ring", which hermetically seals the oscillating piston between the inner area (water) and the outdoor area (air).

The periodic, vertical oscillation of the working piston serves two functions:

1. The extraction of the mechanical energy generated by the Stirling cycle via a crank mechanism and a flywheel 5.
2. The periodic displacement of the working gas in the membrane bags 1 by hydrostatic coupling.

The hot and cold sides pump water from the hot reservoir as well the cold reservoir through non-return valves due to the internal pressure fluctuating from positive to negative pressure.

Figure 10:
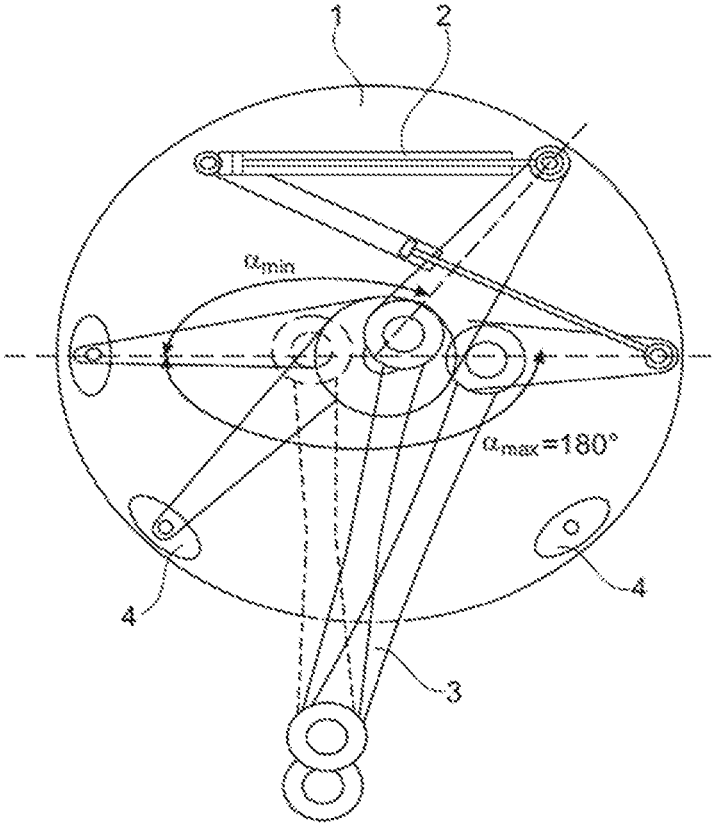
FIG. 10 depicts an embodiment of the invention utilizing an auxiliary hydraulic piston.

In FIG. 10, it is displayed how an auxiliary hydraulic piston is used to continuously adjust the phase angle between the hot and the cold working piston. This serves three purposes:

1. In order not to have to perform compression work when starting the engine, the phase angle is set to 180° for this starting cycle.
2. Pulsation machines of the type described (atmospheric, temperature <100° C.) are particularly well suited as a continuously operating basic load machines, which receive their thermal drive energy from large hot water storage units ("source") and large cold water storage units ("sink"). As already mentioned, they are capable of supplying electrical current, mechanical energy for a variety of purposes, as well as cooling and heating (reversible working pulsating machine) around the clock. In order to adjust the load profile to the time-varying demand profile, the phase angle is adjusted accordingly.
3. The temperatures in the heat accumulators are subject to fluctuations over time. There is an optimal phase angle for each temperature. This can be adjusted automatically via the auxiliary hydraulic piston.
   a. Flywheel 5
   b. Adjustment cylinder
   c. Connecting rod
   d. Counterbalancing weight
   $\alpha_{Max=180°}$ performance zero
   $\alpha_{Max=120°}$ performance max for 90° C.

The previously described form of the Pulsator Stirling engine as per the invention, use pistons for shifting the working gas, which effect the continuous loading and unloading of the working gas into the membrane bags 1 by hydrostatic coupling by periodic offset of the thermal fluid in the work rooms.

Figure 11:
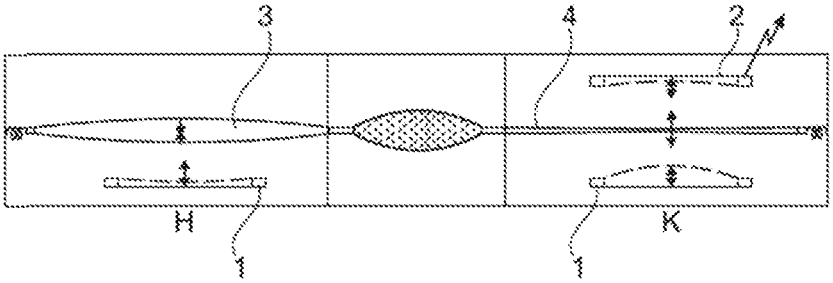
FIG. 11 depicts an embodiment of the invention with speakers presented schematically.

According to the invention, the displacement of the fluid can take place also through membrane loudspeakers brought into the hot and cold space or through piezo crystals. The phase shift between the hot and cold room is achieved here as per the invention through a corresponding electronic control of the two actuators. The production of electrical energy is achieved by a third party loudspeaker (or piezoelectric crystal), which is located in the cold liquid compartment and the pressure fluctuations generated thermodynamically via induction converted into electrical current. Such an arrangement with speakers is displayed schematically in FIG. 11.

1. "Loudspeaker" in the hot and cold compartment. Work electronically controlled in any phase shift; typically 90° for Stirling process.
2. "Loudspeaker" working inversely as power generator.
3. Pulsation membrane unfolded.
4. Pulsation membrane collapsed.

Membrane pulsation machines of this type do not need mechanical release and are very small due to the high operating frequencies.

As described so far, the "heart" of the membrane Stirling engine is based on flexible, thin-walled bags: Pulsators, which contain, periodically shift the working gas as well as isothermically heat and cool it. Due to their inherent features, especially those of the isothermal compression or expansion of gases, these pulsators allow the implementation of technical units other than those of the Stirling machines, according to the invention.

Figure 12:
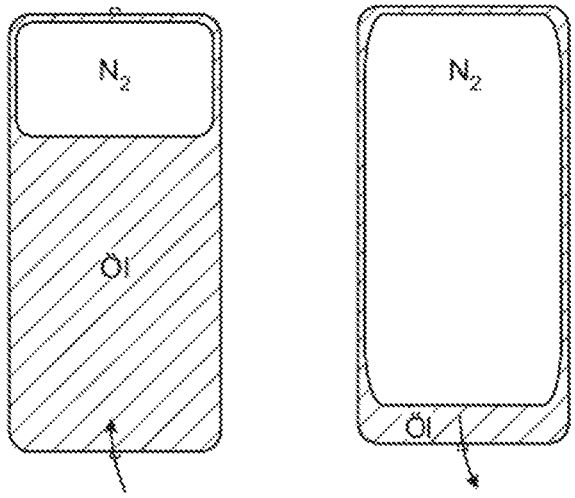
FIG. 12 depicts a classic hydraulic accumulator of an embodiment of the invention displayed schematically.

A typical application of this kind is the "isothermal hydraulic accumulator". In FIG. 12 a classic hydraulic accumulator is displayed schematically. It is typically used for temporarily store the surplus energy accumulated at certain times to return it back to the system at the time, when the system requires additional energy.

Charge: The oil is pumped into the storage unit and compresses the gas (n2) in the rubber bladder.

The process is adiabatic.

Unloading: The compressed gas (n2) expands and pushes the oil out from the storage unit. This oil set under pressure can propel the actuators such cylinders and hydraulic motors.

An application example of such hydraulic accumulators is a vehicle whose drive shaft is coupled with a hydraulic pump in such a way, that oil is pumped during braking of the vehicle and thereby compresses the gas in the storage unit. The energy buffered in this way in the "gas spring" between the stored energy can then then be recovered, if the vehicle is to be accelerated via the pump, which now operates as a hydraulic motor, and is supplied to the drive shaft.

However, this elegant energy recovery process that works with high power density, has a system-related weak point: the compression of the gas is adiabatic. The resulting heating of the gas reduces the buffered pneumatic energy in the gas spring on the one hand and on the other hand, loads the plastic material of the pressure reservoir or as a result, reduces the maximum possible pressure.

Figure 13:
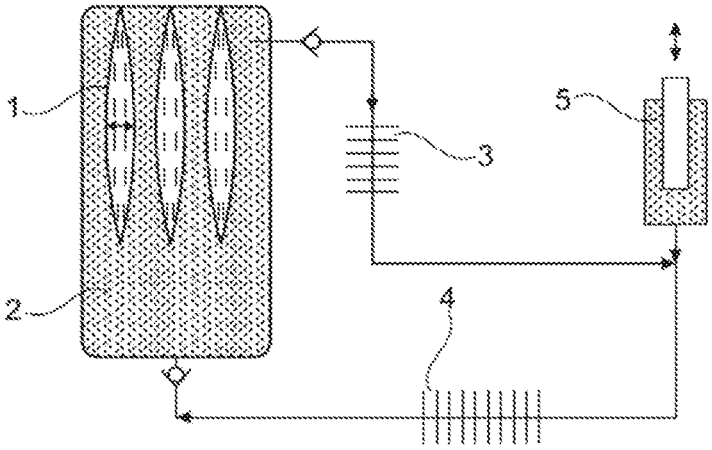
FIG. 13 depicts an embodiment of the invention utilizing an actuator.

According to the invention, the described process of gas compression can now be isothermalized, through the creation of a large surface for heat exchange between compressed oil and compressed gas. As shown in FIG. 13, an actuator (5) (pumps, piston) presses the fluid (2) (preferably hydraulic oil) into a pressure vessel, in which a sufficiently large number of hermetically sealed pulsator membrane bags (1) filled with gas (N2, air and other gases) are found. "Sufficiently large number" here refers to the surface of the pulsation bag. This is measured in such a way that the hydrostatic compression heat generated by hydrostatic compression is transferred well into the flushing liquid, with its higher heat capacities by order of magnitude and thus the desired, virtually isothermal compression takes place.

In the reversible process, the "gas spring" produced by the pulsators press the fluid in the opposite direction through the actuator, which now does not act as a pump as in the previous work cycle but instead as an expander (working machine) and converts the pneumo-hydraulically buffered energy again into mechanical energy with high efficiency into mechanical energy. The gas compression heat absorbed in the fluid is removed for each work cycle by means of coolers (3 and 4) from the circuit.

Figure 14:
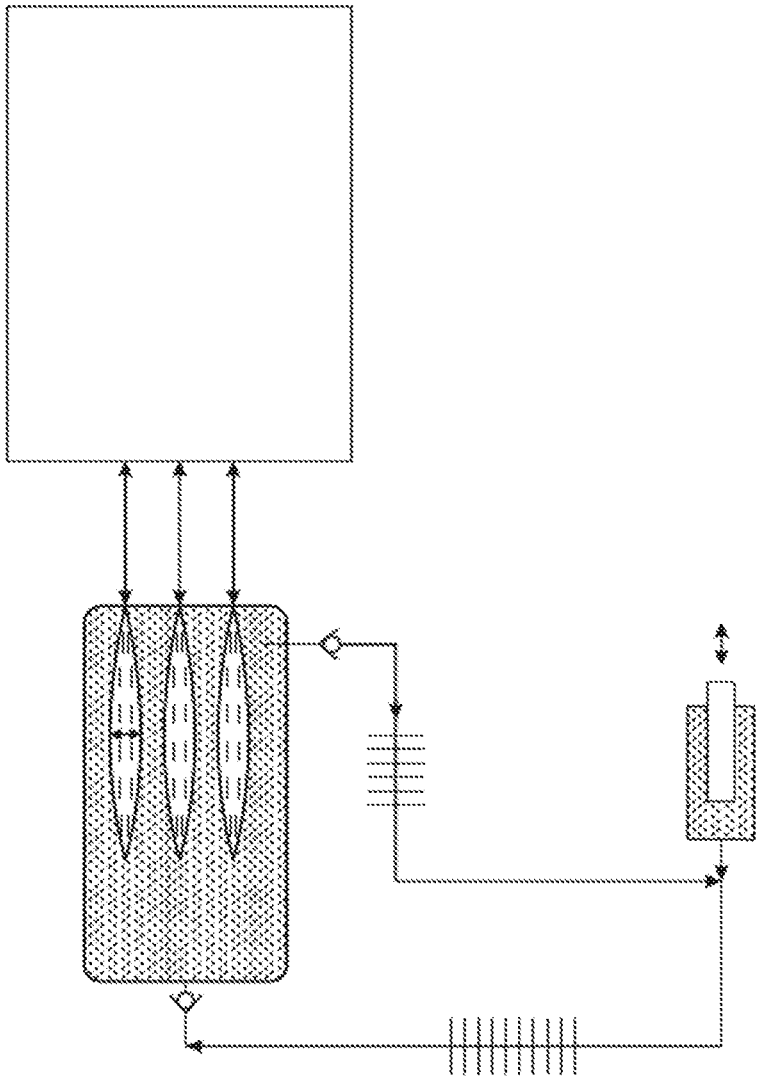
FIG. 14 depicts temporary storage of the mechanical energy over relatively short time intervals of an embodiment of the invention.

The described temporary storage of the mechanical energy over relatively short time intervals, as shown in FIG. 14, can be formed into an isothermal air compressor and compressed air storage in the further technical use of the pulsator principle as per the invention. In this type of application, the pulsator bags are not closed hermetically but instead are periodically filled with ambient air under atmospheric pressure by means of an auxiliary pump, whenever the fluid does not exert any pressure on them. The fluid, which is typically water for these applications, compresses the air in the next working cycle into the pulsator bags, which flows into a compressed air accumulator through a non-return valve. The heat released to the water during compression through the pulsator surface is re-cooled (actively or passively) by means a cooler, when the water is pumped back into the pump, which now has a suction function instead of pressing.

The process is repeated until the desire pressure prevails in the pressure accumulator.

Figure 14A:
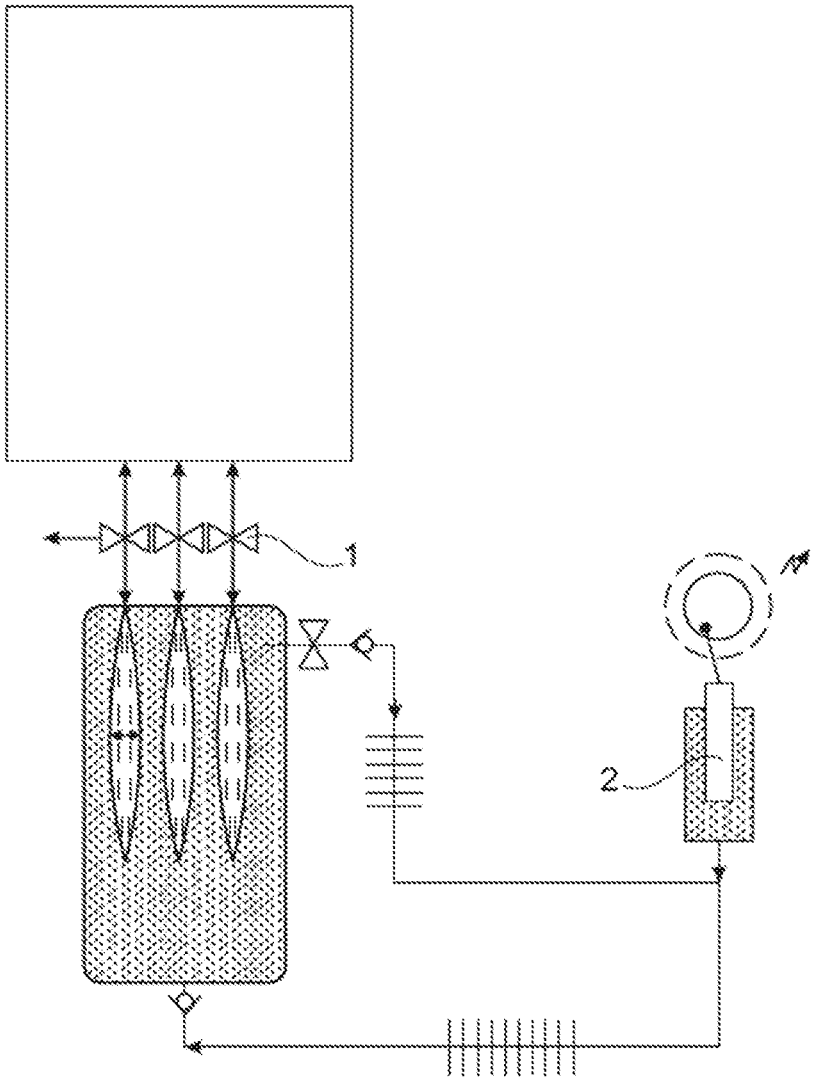
FIG. 14A depicts an embodiment of the invention wherein energy is supplied from the compressed air accumulator.

According to the invention, the arrangement can be expanded in the following manner into an isothermal working machine, which is supplied with energy from the compressed air accumulator: as shown in FIG. 14A, compressed air is conducted periodically from the accumulator into the pulsator bag through a controlled valve. The water, which is absorbs the coolness during the expansion of the compressed air, is reheated by means of a heat exchanger and allows the actuator operating as expander to perform the mechanical work. The actuator engine converts its oscillating movement into rotating energy via a crankshaft, while doing so. A flywheel 5 for equalizing the energy output completes the arrangement.

1. Valve for periodically filling the pulsators with compressed air

2. Actuator as a working machine with a flywheel 5 and generator

A small part of the flywheel 5 energy is used to pump the water back into the pulsator chamber after the expansion (this process requires minimal energy, as the pulsator bag blows off its air into the environment at this point in time).

The air (gas) compressor with integrated compressed air accumulator and an isotherm-operating actuator engine displays especially a good option for a loss-free long-term storage of solar energy. Only if this can be realized with good economy and using ecologically safe and abundantly available material resources, will it be possible to implement the inherent strength of the solar systems and the realization of autonomous basic load power stations of a suitable size.

Compressed air storage units with a nominal pressure of >300 bar, which can be implemented with light, fiber-wrapped polymer pressure accumulators in today's state of the art, reach stored energy densities of >200 Wh/kg during isothermal loading and unloading. Thus they are better than the favorite Li-Ion batteries nowadays (150 Wh/kg) and have the following important benefits, in comparison:

1. No strategically important material components—only water, air, steel, commercial, recyclable membrane
2. Fast loading and unloading times
3. Deep unloadable
4. Ecologically clean
5. Cost-effective
6. An almost unlimited number of cycles.

The drive power of the isothermal compressor can for example be from photovoltaic modules. The mechanical energy, which can then be extracted via the actuator from the compressed air accumulator if required, has other specific advantages, apart from the advantages listed above in comparison to the electro-chemical storage unit: no alternators are required to produce alternating current and power-current—the rotating generator generates them automatically; if required, mechanical energy can be extracted directly from the unit.

A solar-driven membrane Stirling engine as it is the basis of this application, is particularly suitable for the operation of the compressor unit.

If for example, a membrane Stirling engine with 400° C. upper temperature is selected, which converts the heat to electricity with an efficiency of 43%, and lightweight-solar concentrators, which gain process heating with 80% efficiency, the efficiency of the solar power is 34%. In case of a circulating efficiency of the isothermal compressor/expander of 80%, the loss-free energy stored in the compressed air accumulator is available round the clock with the correct dimensioning (solar collector surface to storage volume) with an overall efficiency of 34%×0.8=27.2%. In addition to stationary, decentralized solar base load power stations, solar compressed air filling stations can also be implemented with the described technology.

Figure 15:
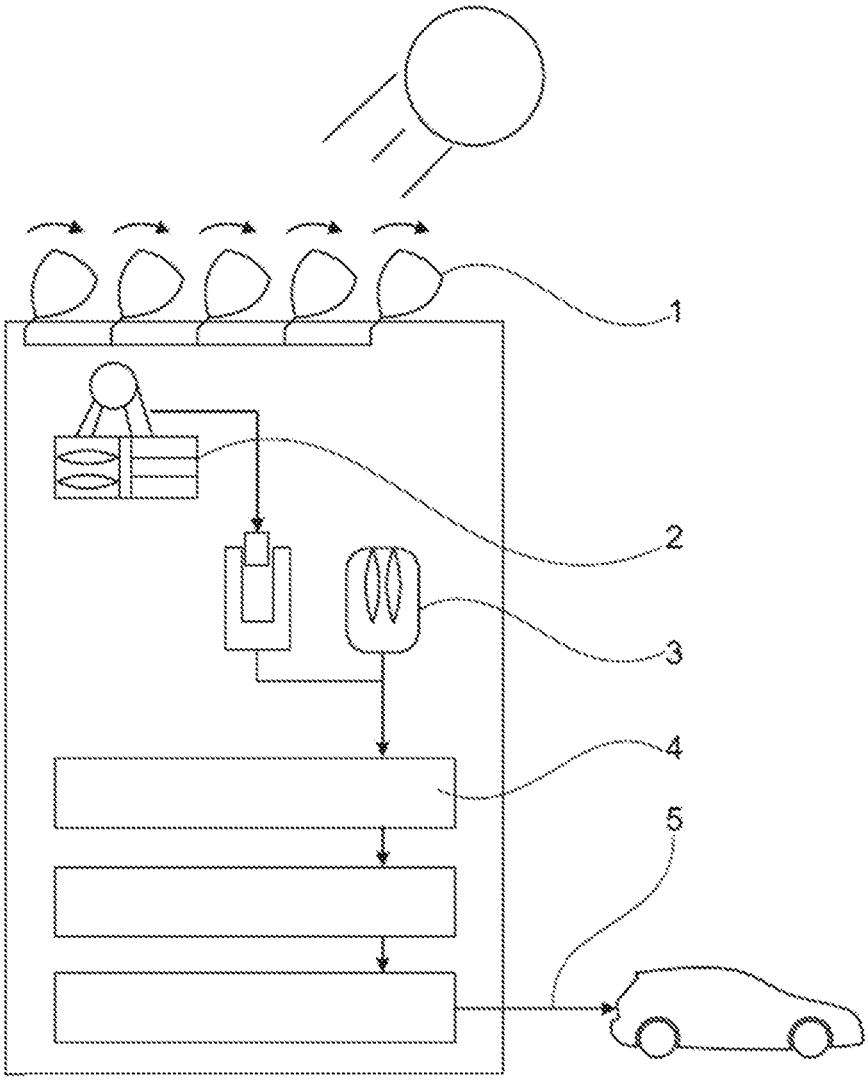
FIG. 15 depicts an embodiment of the invention wherein solar concentrators operate the described isothermal compressors and fill large stationary compressed air storage units.

FIG. 15 schematically shows how solar concentrators (1) on the roof of the garage operate the described isothermal compressors (3) and fill large stationary compressed air storage units (4). In the vehicle to be refueled, there are smaller compressed air storage units (preferably lightweight fiber composite containers formed s load-bearing structural elements). This vehicle storage unit can be "refueled" via compressed air lines by fixed storage units very quickly with compressed air FIG. 5. Actuators functioning isothermally are assigned to the vehicle's storage units, as displayed in FIG. 15. These preferably four individually controllable hydraulic engines, which are integrated in the vehicle's wheels.

In addition to the described actuation of the isothermal compressor and the storage unit by intermittent solar energy (PV or membrane Stirling engine), other forms of renewable energy that is generated in a discontinuous manner are basically suitable (typically: wind, water, waves).

A key feature of the membrane Stirling engine (which the applicant plans to market as "Pulsator Engine") is that the heat exchanger and the displacer bodies installed in the transfer fluid, that is, the pulsators, consist of elastic, deformable membrane structures. A suitable single-layer or multilayer film can serve the purpose of a "membrane" for the purposes of the existing patent application.

In this respect, it deals with an unconventional structure in mechanical engineering, which is based on a natural structure.

I claim:

1. A membrane Stirling engine, characterized in that:

a working gas, a hot part and a cold part, and plurality of pistons for shifting the working gas from the hot part to the cold part, and from the cold part to the hot part, wherein the working gas of the Stirling engine both in the hot part of the Stirling engine as well as in the cold part of the Stirling engine is found in hot part thin-walled membrane skins and cold part thin-walled membrane skins arranged as a stack of membrane bags per piston, further;

wherein each said stack of membrane bags has two ends respectively, wherein one of the two ends hermetically closed and other one of the two ends is open, and wherein, with other one of the open ends opens into the hot or cold room of a regenerator chamber.

2. The membrane Stirling engine according to claim 1, characterized in that the thin-walled gas-filled membrane skins of the hot and cold side form a gas-tight unit with the regenerator chamber, and half of maximum filling volume of the gas is stored in the membrane skins.

3. The membrane Stirling engine according to claim 1, characterized in that membrane skin-regenerator units are positioned in an interior of a pressure-resistant, liquid-tight housing, which on one hand is filled with hot fluid and on other hand, is filled with cold fluid, whereby the regenerator chambers effect the separation of the hot room from the cold room.

4. The membrane Stirling engine according to claim 2, characterized in that membrane skin-regenerator units are positioned in an interior of a pressure-resistant, liquid-tight housing, which on one hand is filled with hot fluid and on other hand, is filled with cold fluid, whereby the regenerator chambers effect separation of the hot room from the cold room.

5. The membrane Stirling engine, according to claim 1, characterized in that a pressure-resistant housing is provided with resources on hot side as well as on cold side, the periodic movement of which pushes the working gas from the membrane skins periodically from the hot side to the cold side and from the cooled side to the hot side through heat-transmitting liquid, wherein an alternating flow of the working gas is formed through the regenerator.

6. The membrane Stirling engine according to claim 5, characterized in that means for periodic displacement of the working gas are mechanically connected to eccentric gear with a phase angle and a flywheel, said means for periodic displacement are coupled thereto in such a way that the working gas dispenses mechanical work outward in accordance with a Stirling cycle by two isochoric and two isothermal process steps.

7. The membrane Stirling engine according to claim 1, characterized in that heat exchange is effected by hot or cold fluid by the membrane skins, into the working gas, by pulsation of the membrane skins, thereby causing a periodic reversal of gas flow direction with corresponding mixing of the working gas and also that thickness of the membrane chamber periodically goes to zero, which leads to particularly high heat transfer values.

8. The membrane Stirling engine according to claim 1, characterized in that the hot part membrane skin and the cold part membrane skin consist of an elastometer made of silicone and/or polyurethane, which is heat-resistant up to over 200° C., and that water is used as liquid immersion at temperatures over 100° C. under pressure.

9. The membrane Stirling engine according to claim 1, characterized in that materials having temperature resistance higher than 200° C. and heat-transmitting high temperature fluids can be used as membrane.

10. The membrane Stirling engine according to claim 2, characterized in that materials having temperature resistance higher than 200° C. and heat-transmitting high temperature fluids can be used as membrane.

11. The membrane Stirling engine according to claim 3, characterized in that materials having temperature resistance higher than 200° C. and heat-transmitting high temperature fluids can be used as membrane.

12. The membrane Stirling engine according to claim 4, characterized in that materials having temperature resistance higher than 200° C. and heat-transmitting high temperature fluids can be used as membrane.

13. The membrane Stirling engine according to claim 5, characterized in that materials having temperature resistance higher than 200° C. and heat-transmitting high temperature fluids can be used as membrane.

14. The membrane Stirling engine according to claim 6, characterized in that materials having temperature resistance higher than 200° C. and heat-transmitting high temperature fluids can be used as membrane.

15. The membrane Stirling engine according to claim 7, characterized in that materials having temperature resistance higher than 200° C. and heat-transmitting high temperature fluids can be used as membrane.

16. The membrane Stirling engine according to claim 1, characterized in that the hot part thin-walled membrane skin and cold part membrane skin are leak tight in hermetic bag regenerator when helium or hydrogen are used as the working gas.

17. The membrane Stirling engine according to claim 6, characterized in that several of the membrane Stirling engines are connected in series in such a way, that rotating extraction mechanism is uniformly supplied with torque and thus the mass of the flywheel can be reduced.

18. The membrane Stirling engine according to claim 6, characterized in that the membrane Stirling engine is operated externally and functions as a heat pump/cooling engine.

19. The membrane Stirling engine according to claim 17 characterized in that the membrane Stirling engine is operated externally and functions as a heat pump/cooling engine.

20. The membrane Stirling engine according to claim 17, characterized in that at least one membrane Stirling engine in the series of connected membrane Sterling engines, is driven by the other thereby forming a Combi engine is formed.

21. The membrane Stirling engine according to claim 18, characterized in that at least one membrane Stirling engine in the series of connected membrane Stirling engines, is driven by the other thereby forming a Combi engine is formed.

22. The membrane Stirling engine according to claim 1, characterized in that the hot part thin-walled membrane skin and cold membrane skins are formed by cylindrical hoses, and these are fiber-wrapped so that they are pressure-resistant in filled state and can be collapsed with hydrostatic power.

23. The membrane Stirling engine according to claim 1, characterized in that displacement function of heat and force-transmitting liquid is generated by sound waves, which are generated by piezoelectric transducers or loudspeaker membranes, which are embedded in the liquid.

24. The membrane Stirling engine according to claim 23, characterized in that the phase shift between the hot and the cold room can be regulated electronically.

25. The membrane Stirling engine according to claim 23, characterized in that the net energy gain of Stirling cycle is transmitted as a pressure variation to the liquid and is converted by the piezo transducer or reversibly working loudspeaker membranes into electric power.

26. The membrane Stirling engine according to claim 24, characterized in that the net energy gain of Stirling cycle is transmitted as a pressure variation to the liquid and is converted by the piezo transducer or reversibly working loudspeaker membranes into electric power.

27. The membrane Stirling engine according to claim 1, characterized in that membrane Stirling Engine is used for isothermal compression and storage of gases.

28. The membrane Stirling engine according to claim 1, characterized in that pulsation of gas-filled membrane bags serve as liquid-gas heat exchangers in a heat-exchanging and force-transmitting liquid immersion.

29. The membrane Stirling engine according to claim 28, characterized in that the membrane skins consist of end-to-end hoses, which stretch from the hot to the cold room and in the middle of which regenerator material enters, wherein the two open ends of hoses are closed with mechanical clamping bars, which are fastened with the help of springs on interior walls of fluid cylinders, in form of lines.

30. The membrane Stirling engine according to claim 29, characterized in that areas of the membrane skins filled with regenerator material are delimited on the right and left with heat-insulating walls, which separate the liquid cylinders into the hot and the cold room, where the hoses are being conducted through corresponding slots in the heat-insulating walls, and further, are the volume of fluid in the inside of separating walls are not moved by the pulsation hot and cold fluid spaces; and this function can be supported by addition of a gelling agent into water supports.

31. The membrane Stirling engine according to one of claims 9 to 15, where the heat-transmitting high temperature fluid is a silicon thermal oil.

* * * * *